United States Patent [19]

Stibbe et al.

[11] 4,201,323

[45] May 6, 1980

[54] HIGH VELOCITY WEB FLOATING AIR BAR HAVING A RECESSED COANDA PLATE

[75] Inventors: Paul H. Stibbe, DePere; Robert A. Daane, Green Bay, both of Wis.

[73] Assignee: W. R. Grace & Co., New York, N.Y.

[21] Appl. No.: 950,742

[22] Filed: Oct. 12, 1978

[51] Int. Cl.[2] ..... B65H 17/32

[52] U.S. Cl. ..... 226/97; 34/156

[58] Field of Search ..... 226/7, 97, 196; 34/57 R, 57 A, 156; 242/75.3, 76

[56] References Cited

U.S. PATENT DOCUMENTS

| | | | |
|---|---|---|---|
| 3,324,570 | 6/1967 | Flaith et al. | 34/156 |
| 3,498,515 | 3/1970 | Johnson | 226/97 |
| 3,549,070 | 12/1970 | Frost et al. | 226/97 |
| 3,873,013 | 3/1975 | Stibbe | 226/97 |

*Primary Examiner*—Leonard D. Christian
*Attorney, Agent, or Firm*—James E. Nilles

[57] ABSTRACT

An air bar for floating a running web and having two spaced apart air nozzles through which pressurized air is directed against the web to form a supporting air cushion for the web. The nozzles are elongated slots extending transversely of the web and which are positioned at each edge of an intervening plate that also is located transversely of and closely adjacent the running web. The plate has curved edges, one located adjacent each of the slots whereby the air issuing from the slots tends to follow the curvature of the curved edges, thereby tending to direct the two issuing jets of air from the slots towards one another. The plate, commonly referred to as a Coanda plate, has a recessed portion between the slots and which is located inwardly or below the slots to thereby create a sufficient space between the web and the plate to cause generation of air turbulence, vortexes and eddy currents in the pressurized air zone or cushion between the web and the plate, which results in increased floatation pressure for the web and increased heat transfer of the material, such as printing, which is on the web.

3 Claims, 5 Drawing Figures

A
W
F
D
P
4
3
10
12
14
15
16
17
20
25
27
d
α

HIGH VELOCITY WEB FLOATING AIR BAR HAVING A RECESSED COANDA PLATE

BACKGROUND OF THE INVENTION

This invention pertains to web handling apparatus such as air bars for floatingly suspending a running web and drying the material such as ink on the web, without permitting the web to touch any supporting surfaces. The invention is in the nature of an improvement over U.S. Pat. No. 3,549,070 which issued Dec. 22, 1970 to Frost et al entitled "Floatation of Sheet Materials" and also over U.S. Pat. No. 3,873,013 which issued Mar. 25, 1975 to Paul H. Stibbe entitled "High Velocity Web Floating Air Bar having Central Exhaust Means", both of which have been assigned to an assignee common with the present invention.

The present invention utilizes the Coanda effect found in the above two patents, but eliminates the need for center holes in the air bar plates, which holes were used to interrupt the flow of air completely across the air bar from one air slot to the other, thereby acting as a spoiler, and furthermore, permits a greater portion of the air jets issuing from the slots to go inwardly towards the center of the air bar, thereby increasing the drying and floatation capacity over the prior art devices.

SUMMARY OF THE PRESENT INVENTION

The present invention provides an elongated and generally tubular air bar which is adapted to be positioned closely adjacent to a running web for supporting the web on a cushion of air. The bar has a recessed plate with spaced apart curved edges extending transversely of and located closely adjacent the web. A pair of air supply slots, one located and extending along each of the curved edges act to discharge pressurized air against the web, the air as it issues from the slots tending to follow the curvature of the edges in the known manner referred to as the "Coanda effect". The recessed plate is located below the slots, in respect to the web, and is located between the slots whereby the pressurized zone or cushion is enlarged as to its depth thereby providing space for the generation of larger scale air turbulence, vortexes and eddy currents in the pressurized air cushion and which results in increased heat transfer of material on the web. Having this recessed portion of the plate also promotes stability of the desired symmetrical flow pattern from the two slots; i.e., it prevents air from one slot sweeping across the plate and over the other slot. Such unsymmetrical flow is undersirable because it causes a change in heat transfer rate where it occurs, thus leading to non-uniform heat transfer across the web width.

DESCRIPTION OF A PREFERRED EMBODIMENT

Figures 1, 2, 3, 4, 5:
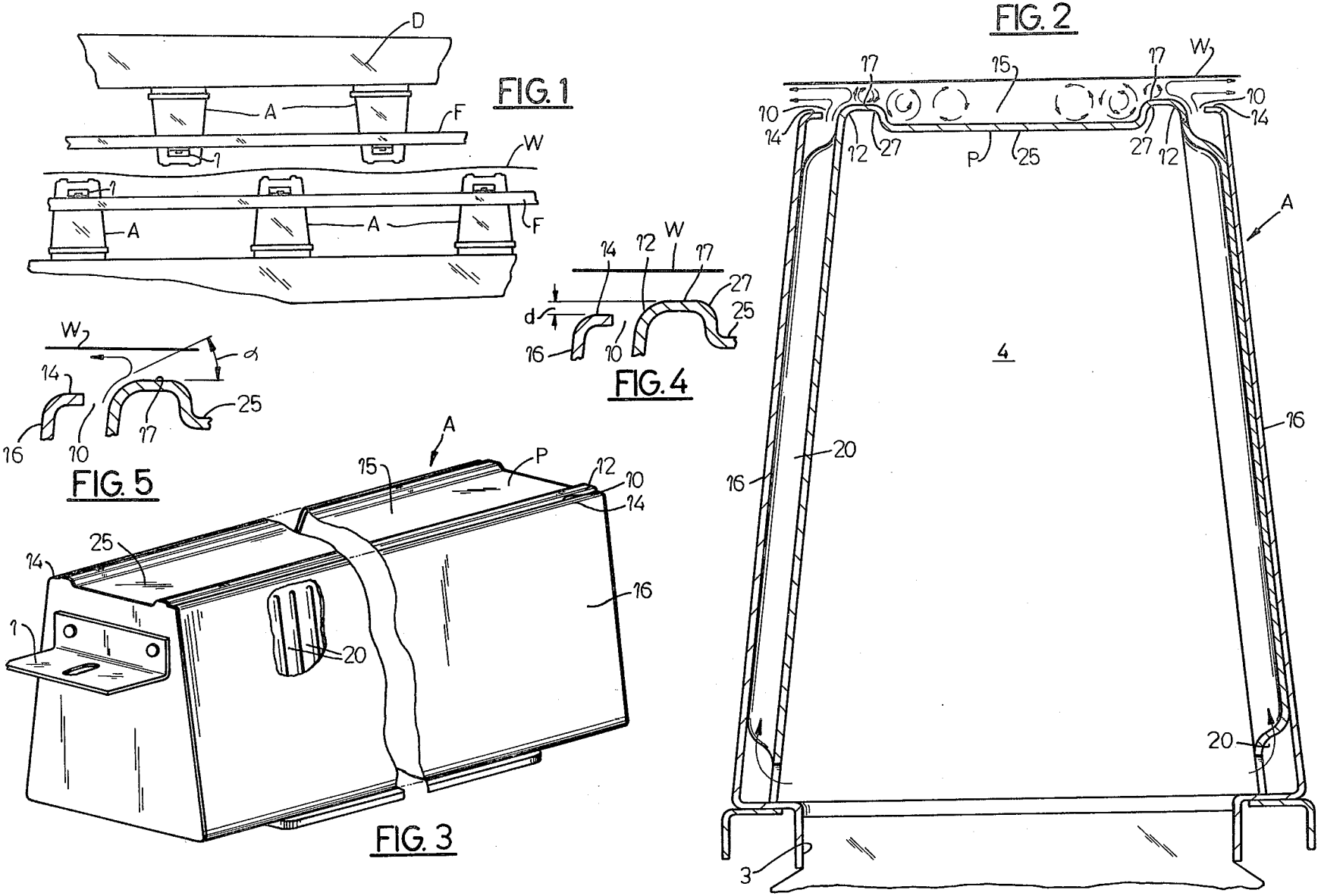
FIG. 1 is a schematic, side elevational view of a plurality of air bars made in accordance with the present invention and as they may be disposed on opposite sides of a running web and in staggered relationship on one side of the web from the other.
FIG. 2 is an enlarged, cross-sectional view through one of the air bars made in accordance with the present invention.
FIG. 3 is a perspective view of one of the air bars made in accordance with the present invention, but on a reduced scale from that shown in FIG. 2, and partially broken away.
FIG. 4 is an enlarged, fragmentary view of a portion of the air bar shown in FIG. 2.
FIG. 5 is a view similar to FIG. 4 but illustrating the air flow direction as it separates from the Coanda surface by the reference angle$\alpha$.

One general organization of air bars A made in accordance with the present invention is shown in FIG. 1 in which the air bars are secured by brackets 1 to the frame F of the machine. The air bars are secured to a duct D through which pressurized air is fed via the opening 3 (FIG. 2) in the air bar and to the center chamber 4 of the generally tubular and elongated shaped air bar. The air bars can be mounted in various ways to the supply ducts and it is believed sufficient to say that examples of such mountings are shown in the U.S. Pat. No. 3,739,491 of June 19, 1973 to Creapo el al entitled "High Velocity Air Web Dryer"; U.S. Pat. No. 3,776,440 of Dec. 4, 1973 to Frost et al, and entitled "Web Handling Apparatus", or in the said U.S. Pat. No. 3,873,013, all of which have been assigned to an assignee common with the present invention.

Thus, an elongated and generally tubular air bar A is adapted to be positioned closely adjacent the running web W for supporting the web on a cushion or zone of pressurized air located between the air bar and the web. The air bar defines a pressurizable central chamber 4 into which pressurized air is conducted by suitable ducts D for discharge through a pair of air supply slots 10 and against the web W.

The air bar A has a recessed plate P located between the slots 10, the plate P having a pair of curved edges 12 extending transversely of and located closely adjacent the web W. Flange 14 of each side wall 16 of the air bar is located a distance d (FIG. 4), on the order of 1/16" from the outermost surface 17 of the plate P and this relatively small distance, as compared to prior art devices, increases the floatation pressure developed by the air bar because the effective angle $\alpha$ (FIG. 5) of the air jet from the slots 10 as it enters the zone or cushion 15 of pressurized air that is located between the web and the plate, is closer to the direction of the plane in which the web is located and therefore there is a larger reaction by the jet in building up the air cushion as will appear.

As explained in the U.S. Pat. No. 3,549,070, the curved corner 12 located adjacent the slot 10 acts with a Coanda effect, that is the air issuing from the slot 10 tends to follow the curvature of the curved corner 12. Depending on the distance of the web from the slot, the air as it issues from the slot 10 can be varied as to its amount of hugging or affinity for following the curved corner in accordance with the Coanda principle, and reference may be had to said patent for a further description of the Coanda effect if it is deemed to be necessary or desirable.

It is believed sufficient to say for purposes of this disclosure that the slots 10 are in air receiving communication with the central chamber 4, via separate passageways 20 in the bar, for receiving pressurized air therefrom and this air is then discharged through the slots for impingement against the web to form a pressurized air cushion or zone between the web W and plate P. The general pattern of air flow from the slots 10 is also shown by the arrows in FIG. 2.

The plate P is formed with a central recess portion 25 which is located inwardly of the slots 10, in respect to the web W. Recessed portion 25 of the plate is located preferably about 3/32" below slots 10. It should be noted that the corners 27 of the plate P, which corners are located inwardly towards one another with respect to the outer Coanda corners 12, are preferably of a sharper of smaller radius, say 1/16" or less, than the corners 12, which are preferably ⅛" to 5/23" radius, so that the air as it travels around corner 12 comes off of the outermost surface 17 in a turbulent manner, thereby generating good turbulence in the pressure zone. In other words, sharp inner corner portions 27 result in more turbulence, eddy currents and vortexes which enhance the drying or heat transfer ability of the air bar. The sharp inner corner 27 also prevents the flow of air from one slot sweeping across the air bar and over the other slot. This non-symmetrical flow pattern is undersirable because it reduces the web supporting cushion pressure and makes it unsymmetrical, thus leading to a skew in the web path and possible rubbing on the air bar. Furthermore, this unsymmetrical flow pattern reduces the heat transfer coefficient where it occurs. Since this disturbed flow pattern is only metastable, it only occurs in certain locations along an air bar and thus leads to non-uniform heat transfer across the width of a web being dried. The sharpcorner 27 prevents this non-symmetry of flow by causing any potential "sweep across" flow stream to break up into vortexes and eddies, thus reducing its coherence and also its effectiveness in overcoming the opposing barrier provided by the opposite jet.

Thus, the air bar above described, with its outer Coanda corners closely adjacent and parallel to the air supply slots, provides for increased floatation pressure. The recessed portion 25 of Coanda plate P provides additional space in the zone between the web and the plate which increases the drying capacity or heat transfer of the air bar because of the turbulence, vortexes and eddy currents which are generated with the present air bar. The present bar thus provides larger scale eddy currents and a more favorable split of the jet of air issuing from the slots, that is a more favorable split of the air between that which flows inwardly towards the recessed portion of the plate and that air which flows outwardly from the slot 10 and along the web. The recessed portion 25 of the plate acts to interrupt the flow of air from one slot 10 to the other which may otherwise occur if the spoiler effect of the recessed portion 25 were not present. Thereby the necessity of center holes in the Coanda bar are not required for acting as a spoiler and preventing one slot from taking over the Coanda effect at the other side of the air bar.

The larger space provided by the recessed plate permits a larger portion of the jet of air issuing from the slot to turn inwardly into the pressurized cushion zone without the need for center exhaust holes in the plate.

We claim:

1. An elongated and generally tubular air bar for positioning a running web and comprising, opposite side walls, a plate located between said side walls and having spaced apart longitudinal and curved edges locatable closely adjacent the running web to be supported, and a pair of air supply slots one extending in parallelism along each of said edges to form air discharging nozzles therewith for directing a stream of pressurized air out of the interior of said air bar and against said web to form a pressurized air zone between said web and said bar, a portion of said streams tending to follow around said curved edges whereby said portions of said streams discharged by said pair of nozzles tend to move into said pressurized air zone, said plate having a central recessed portion which is located inwardly of said slots so as to provide space in said zone for the generation of air turbulence, vortexes and eddy currents for increased heat transfer of material on said web and increased web floatation pressure.

2. An air bar for floating a continuous running web, said bar being elongated and of enclosed tubular shape and including opposite side walls, and a plate located between said side walls, said plate having spaced apart longitudinal and curved edges and locatable closely adjacent the running web to be supported, said bar also having a pair of air supply slots one extending along and in parallelism with each of said edges to form opposed Coanda nozzles therewith and for directing a stream of pressurized air out of the interior of said air bar and against said web to form a pressurized air zone between said web and plate, a portion of said streams tending to follow said curved edges and toward the center of said bar whereby said portion of said streams discharged by said pair of opposed nozzles tend to move into said pressurized air zone, said plate having a central recessed portion which is located from said web inwardly of said slots so as to provide space in said zone for the generation of air turbulence, vortexes and eddy currents for increased heat transfer of material on said web and increased web floatation pressure.

3. An elongated and generally tubular air bar adapted to be positioned closely adjacent a running web for supporting said web on a cushion of air, said air bar defining a pressurizable central chamber into which pressurized air is conducted and having means communicating with a pressurized air supply, said bar having a recessed plate with spaced apart outer portions having curved edges extending transversely of and located closely adjacent said web, said bar also having a pair of air supply slots, one located and extending along each of said curved edges, said slots being in air receiving communication with said central chamber for receiving pressurized air therefrom, whereby pressurized air in said central chamber is discharged through said slots for impingement against said web to form a pressurized air cushion between said web and said plate, said plate having a central and inwardly recessed portion which is located inwardly of said slots and outer portions to define space in said pressurized air cushion for the generation of air turbulence, vortexes and eddy currents for increased heat transfer of material on said web and increased web floatation pressure.

* * * * *